US011280551B2

(12) United States Patent
Kim et al.

(10) Patent No.: US 11,280,551 B2
(45) Date of Patent: Mar. 22, 2022

(54) MICRO CHANNEL TYPE HEAT EXCHANGER

(71) Applicant: LG ELECTRONICS INC., Seoul (KR)

(72) Inventors: Beomchan Kim, Seoul (KR); Byoungjin Ryu, Seoul (KR); Taeman Yang, Seoul (KR); Choonmyun Chung, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 219 days.

(21) Appl. No.: 15/260,914

(22) Filed: Sep. 9, 2016

(65) Prior Publication Data

US 2017/0074591 A1 Mar. 16, 2017

(30) Foreign Application Priority Data

Sep. 11, 2015 (KR) ..... 10-2015-0129285

(51) Int. Cl.

| | |
|---|---|
| ***F28D 1/053*** | (2006.01) |
| ***F28F 9/02*** | (2006.01) |
| ***F28D 1/04*** | (2006.01) |
| ***F28F 1/12*** | (2006.01) |
| *F28D 21/00* | (2006.01) |

(52) U.S. Cl.

CPC ..... *F28D 1/05391* (2013.01); *F28D 1/0417* (2013.01); *F28D 1/0435* (2013.01); *F28F 1/124* (2013.01); *F28F 9/0202* (2013.01); *F28F 9/0204* (2013.01); *F28F 9/0212* (2013.01); *F28D 2021/0071* (2013.01); *F28F 2260/02* (2013.01); *F28F 2270/00* (2013.01)

(58) Field of Classification Search

CPC .. F28D 1/05391; F28D 1/0417; F28D 1/0435; F28D 1/124; F28F 9/0202; F28F 9/0204; F28F 9/0212; F28F 2260/02; F28F 2270/00

See application file for complete search history.

(56) References Cited

U.S. PATENT DOCUMENTS

| | | | | |
|---|---|---|---|---|
| 9,157,688 | B2 * | 10/2015 | Samuelson | F28D 1/05375 |
| 2007/0193731 | A1 * | 8/2007 | Lamich | F28D 7/1692 165/149 |

(Continued)

FOREIGN PATENT DOCUMENTS

| | | |
|---|---|---|
| EP | 0 414 433 A2 | 2/1991 |
| JP | 11-142087 A | 5/1999 |

(Continued)

*Primary Examiner* — Devon Russell

(74) *Attorney, Agent, or Firm* — Dentons US LLP

(57) ABSTRACT

A micro channel type heat exchanger in which a first heat exchange module and a second heat exchange module are stacked, the micro channel type heat exchanger including a plurality of flat tubes disposed within the first heat exchange module and the second heat exchange module, and a heat blocking member configured to form a heat blocking space by separating the first heat exchange module and the second heat exchange module, wherein the heat blocking member forms a heat blocking space between the first heat exchange module and the second heat exchange module that minimizes heat conductivity and improves thermal exchange performance of the heat exchanger.

5 Claims, 9 Drawing Sheets

(56) References Cited

U.S. PATENT DOCUMENTS

| | | | | |
|---|---|---|---|---|
| 2015/0053376 | A1* | 2/2015 | Matsumoto | F28F 9/0204 165/144 |
| 2015/0226498 | A1* | 8/2015 | Park | F28D 1/05391 165/174 |
| 2016/0138871 | A1* | 5/2016 | Matsumoto | F28F 9/028 165/143 |

FOREIGN PATENT DOCUMENTS

| | | | | | |
|---|---|---|---|---|---|
| JP | 2004-144395 | A | | 5/2004 | |
| JP | 2004144395 | A | * | 5/2004 | |
| JP | 2004-183960 | A | | 7/2004 | |
| JP | 2013-134016 | A | | 7/2013 | |
| JP | 2013-234839 | A | | 11/2013 | |
| JP | 2013231573 | A | * | 11/2013 | F25B 40/02 |
| JP | 2014-1896 | A | | 1/2014 | |
| JP | 2014001896 | A | * | 1/2014 | |
| JP | 2014-228240 | A | | 12/2014 | |
| WO | 2014/189112 | A1 | | 11/2014 | |

* cited by examiner

MICRO CHANNEL TYPE HEAT EXCHANGER

CROSS-REFERENCE TO RELATED APPLICATION

The application claims priority under 35 U.S.C. § 119 to Korean Patent Application No. 10-2015-0129285, filed Sep. 11, 2015, whose entire disclosure is hereby incorporated by reference.

BACKGROUND OF THE INVENTION

1. Field of the Invention

A micro channel type heat exchanger.

2. Discussion of the Related Art

In general, a heat exchanger may be used as a condenser or evaporator in a freezing cycle device including a compressor, a condenser, an expansion unit, and an evaporator. The heat exchanger may be classified as either a pin tube type heat exchanger or a micro channel type heat exchanger depending on its structure.

Generally, the pin tube type heat exchanger is made of copper and the micro channel type heat exchanger is made of aluminum. The micro channel type heat exchanger is generally more efficient than the pin tube type heat exchanger because a fine flow channel is formed therein. The pin tube type heat exchanger can be easily fabricated because a pin and a tube are welded. In contrast, the micro channel type heat exchanger generally requires a higher initial investment cost because it is fabricated using a brazing process. The pin tube type heat exchanger can be easily fabricated with them stacked in two columns, whereas the micro channel type heat exchanger is more difficult to fabricate in two columns because it is put into a furnace and fabricated.

FIG. 1 is a perspective view of a conventional micro channel type heat exchanger such as described in Korean Patent No. 10-0765557, which is incorporated herein by reference. As shown, the conventional micro channel type heat exchanger includes a first column 1 and a second column 2, and includes a header 3 connecting the first column 1 and the second column 2. The header 3 provides a flow channel for changing the direction of the refrigerant of the first column 1 to the second column 2. In the conventional micro channel type heat exchanger including the two columns, the inflow hole 4 of a refrigerant is disposed below the first column 1, and the discharge hole 5 of a refrigerant on the lower side of the second column 2.

In particular, a plurality of the inflow holes 4 are formed. A refrigerant is supplied to the first column 1 through a plurality of flow channels. In the first column 1, a refrigerant flows from bottom to top. In the second column 2, the refrigerant passes through the header 3 and flows from top to bottom. A single discharge hole 5 is disposed. That is, fluids passing through the first column 1 are joined in some place of the second column 2, collected in the discharge hole 5, and then discharged.

However, if the conventional micro channel type heat exchanger is used as an evaporator, there is a problem in that a pressure loss is generated because a refrigerant is evaporated in the process of the refrigerant flowing from the first column 1 to the second column 2.

SUMMARY OF THE INVENTION

An object of the invention is directed to a micro channel type heat exchanger having a structure that is capable of minimizing a thermal loss through a fixed plate for separating headers.

Another object of the invention is directed to a micro channel type heat exchanger having a structure capable of reducing a pressure loss of a refrigerant when it is used as an evaporator.

Another object of the invention is directed to the provision of a micro channel type heat exchanger having a structure capable of operating as a single pass in two stacked heat exchange modules.

The technical objects to be achieved by the present invention are not limited to the aforementioned objects, and those skilled in the art to which the present invention pertains may understand other technical objects from the following description.

According to an embodiment of the invention, there is provided a micro channel type heat exchanger in which a first heat exchange module and a second heat exchange module are stacked. The first heat exchange module and the second heat exchange module include a plurality of flat tubes. The micro channel type heat exchanger includes a heat blocking member configured to form a heat blocking space by separating the first heat exchange module and the second heat exchange module.

The heat blocking member may be inserted between the first heat exchange module and the second heat exchange module, and the heat blocking space may be formed between the first heat exchange module and the second heat exchange module.

The heat blocking member may be fixed to the outsides of the first heat exchange module and the second heat exchange module, and the heat blocking space may be formed between the first heat exchange module and the second heat exchange module.

The heat blocking member may further include an insertion part inserted between the first heat exchange module and the second heat exchange module and configured to support the first heat exchange module and the second heat exchange module.

The micro channel type heat exchanger may further include a first pass which is disposed in some of the plurality of flat tubes disposed in the first heat exchange module and along which a refrigerant flows in one direction; a second pass which is disposed in the remaining some of the plurality of flat tubes disposed in the first heat exchange module and along which the refrigerant supplied from the first pass flows in the opposite direction to the direction of the first pass; a third pass which may be distributed and disposed in the remainder of the plurality of flat tubes disposed in the first heat exchange module other than the first pass and the second pass and in some of a plurality of flat tubes disposed in the second heat exchange module; and a fourth pass which is disposed in the remainder of the plurality of flat tubes disposed in the second heat exchange module and along which a refrigerant supplied from the third pass flows in the opposite direction to the direction of the third pass. The third pass may include a (3-1)-th pass which is disposed in the remainder of the plurality of flat tubes disposed in the first heat exchange module other than the first pass and the second pass and along which the refrigerant supplied from the second pass flows in the opposite direction to the direction of the second pass and a (3-2)-th pass which is disposed in some of the plurality of flat tubes disposed in the second heat exchange module and along which the refrigerant supplied from the second pass flows in the opposite direction to the direction of the second pass and flows a direction identical to the direction of the (3-1)-th pass.

The first heat exchange module may include the plurality of flat tubes configured to have a refrigerant flow along the flat tubes; a pin configured to connect the flat tubes and to conduct heat; a first lower header connected to one side of the plurality of flat tubes and configured to communicate with one side of the plurality of flat tubes so that the refrigerant flows; a first upper header connected to the other side of the plurality of flat tubes and configured to communicate with the other side of the plurality of flat tubes so that the refrigerant flows; a first baffle disposed within the first lower header and configured to form the first pass and the second pass by partitioning an inside of the first lower header; and a second baffle disposed within the first upper header and configured to form the second pass and the (3-1)-th pass by partitioning an inside of the second upper header. The second heat exchange module may include the plurality of flat tubes configured to have a refrigerant flow in the flat tubes; a pin configured to connect the flat tubes and to conduct heat; a second lower header connected to one side of the plurality of flat tubes and configured to communicate with one side of the plurality of flat tubes so that a refrigerant flows; a second upper header connected to the other side of the plurality of flat tubes and configured to communicate with the other side of the plurality of flat tubes so that the refrigerant flows; and a third baffle disposed within the second lower header and configured to form the (3-2)-th pass and the fourth pass by partitioning the second lower header. The heat blocking member may be disposed between the first upper header and the second upper header or between the first lower header and the second lower header or both.

A first upper hole may be formed in the first upper header in which the (3-1)-th pass has been formed, a second upper hole may be formed in the second upper header in which the (3-2)-th pass has been formed, some of the refrigerant of the third pass flows in the second upper header through the first upper hole and the second upper hole, and the heat blocking member may be disposed between the first upper hole and the second upper hole.

The heat blocking member may include a first plate hole configured to connect the first upper hole and the second upper hole so that the refrigerant flows.

A first lower hole may be formed in the first lower header in which the (3-1)-th pass has been formed, a second lower hole may be formed in the second lower header in which the (3-2)-th pass has been formed, some of the refrigerant of the third pass flows in the second lower header through the first lower hole and the second lower hole, and the heat blocking member may be disposed between the first lower hole and the second lower hole.

The heat blocking member may include a second plate hole configured to connect the first lower hole and the second lower hole so that the refrigerant flows.

A first upper hole may be formed in the first upper header in which the (3-1)-th pass has been formed, a second upper hole may be formed in the second upper header in which the (3-2)-th pass has been formed, and some of the refrigerant of the third pass flows in the second upper header through the first upper hole and the second upper hole. A first lower hole may be formed in the first lower header in which the (3-1)-th pass has been formed, a second lower hole may be formed in the second lower header in which the (3-2)-th pass has been formed, and the remainder of the refrigerant of the third pass flows in the second lower header through the first lower hole and the second lower hole. The heat blocking member may include a first heat blocking member disposed between the first upper hole and the second upper hole and a second heat blocking member disposed between the first lower hole and the second lower hole.

The first heat blocking member may further include a first plate hole configured to connect the first upper hole and the second upper hole. The second heat blocking member may further include a second plate hole configured to connect the first lower hole and the second lower hole.

The micro channel type heat exchanger may further include a first separation space formed between the first pass and the second pass, a second separation space formed between the second pass and the (3-1)-th pass, and a third separation space formed between the (3-2)-th pass and the fourth pass.

The first baffle may be disposed over or under the first separation space, the second baffle may be disposed over or under the second separation space, and the third baffle may be disposed over or under the third separation space.

The number of flat tubes forming the (3-1)-th pass may be identical with the number of flat tubes forming the (3-2)-th pass.

The number of flat tubes disposed in each of the first pass, the second pass, the third pass, and the fourth pass may be gradually increased.

15% of all of the flat tubes of the first heat exchange module and the second heat exchange module may be disposed in the first pass, 20% of all of the flat tubes of the first heat exchange module and the second heat exchange module may be disposed in the second pass, 30% of all of the flat tubes of the first heat exchange module and the second heat exchange module may be disposed in the third pass, and 35% of all of the flat tubes of the first heat exchange module and the second heat exchange module may be disposed in the fourth pass.

The heat blocking member may be inserted between the first heat exchange module and the second heat exchange module, and the heat blocking space may be formed between the first heat exchange module and the second heat exchange module.

The heat blocking member may be fixed to the outsides of the first heat exchange module and the second heat exchange module, and the heat blocking space may be formed between the first heat exchange module and the second heat exchange module.

The heat blocking member may further include an insertion part inserted between the first heat exchange module and the second heat exchange module and configured to support the first heat exchange module and the second heat exchange module.

BRIEF DESCRIPTION OF THE DRAWINGS

The accompanying drawings, which are included to provide a further understanding of the invention and are incorporated in and constitute a part of this application, illustrate embodiments of the invention and together with the description serve to explain the principle of the invention. In the drawings.

DETAILED DESCRIPTION OF THE EMBODIMENTS

Figure 1:
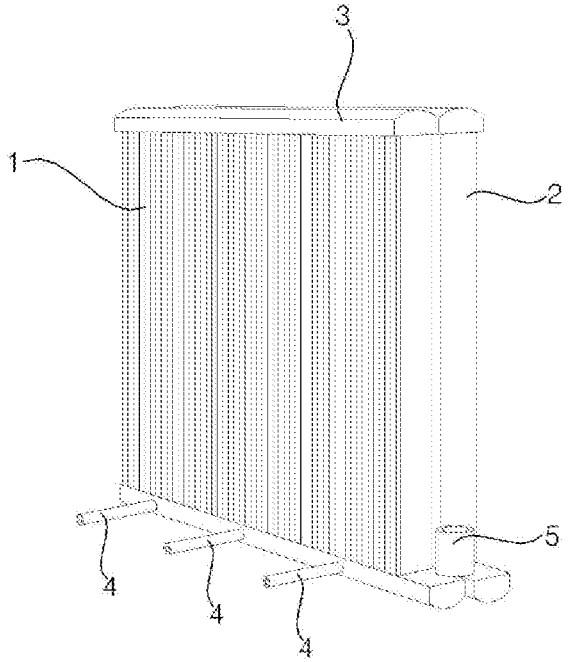
FIG. 1 is a perspective view of a conventional micro channel type heat exchanger.
Figure 2:
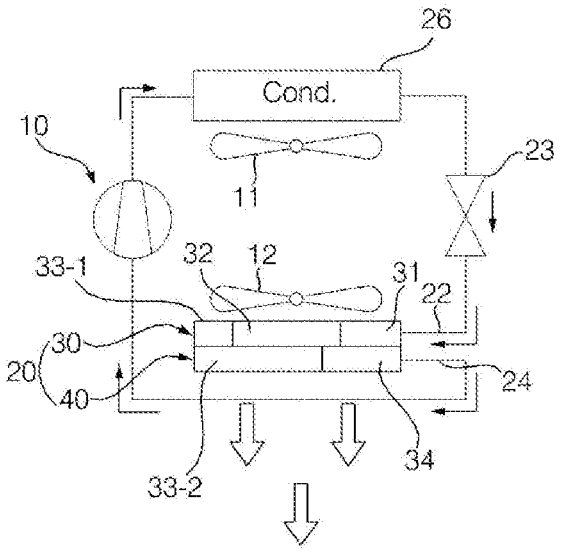
FIG. 2 is a block diagram of an air-conditioner according to an embodiment of the invention.
Figure 3:
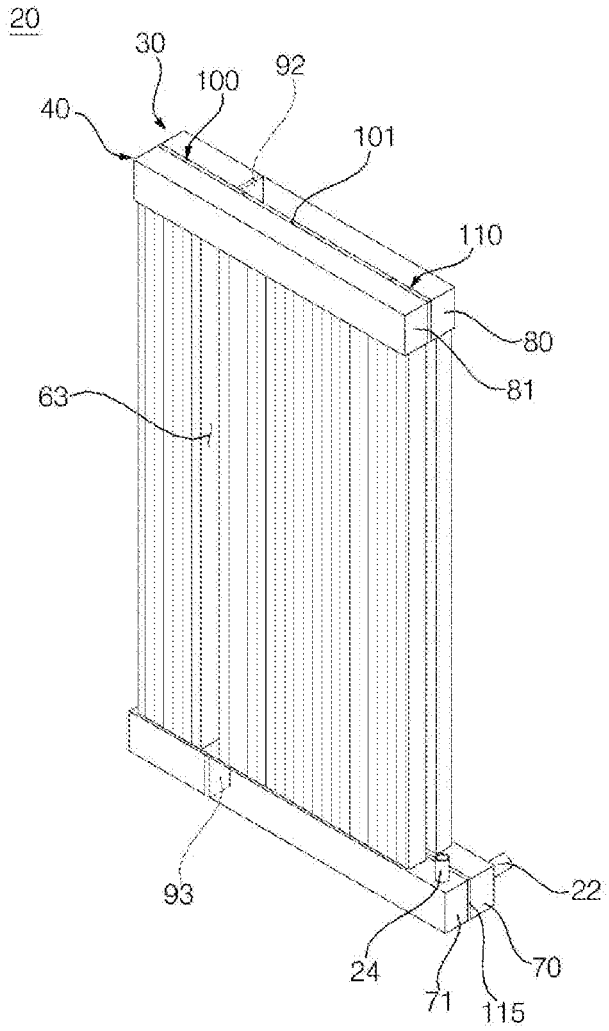
FIG. 3 is a perspective view of an evaporation heat exchanger of FIG. 2.
Figure 4:
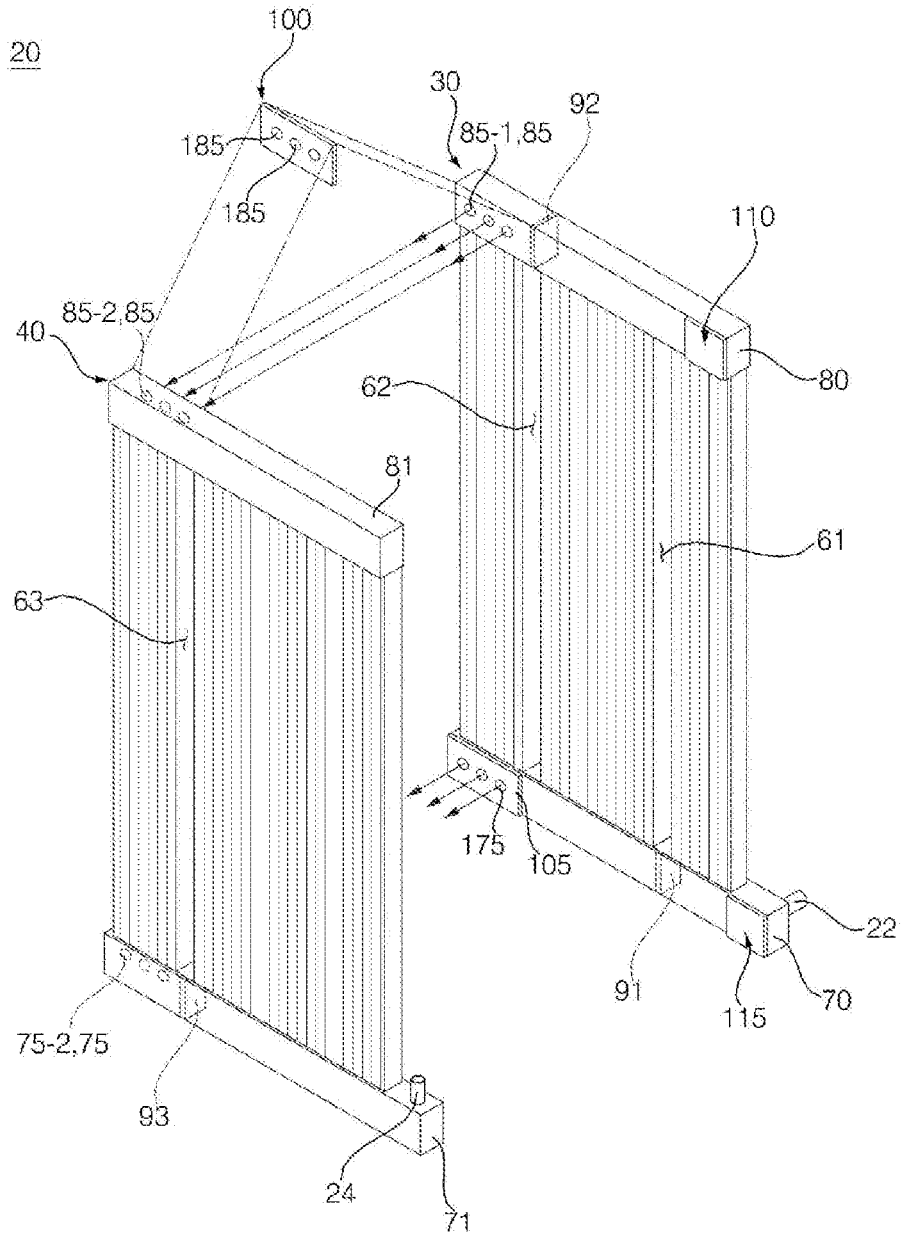
FIG. 4 is an exploded perspective view of the evaporation heat exchanger of FIG. 3.
Figure 5:
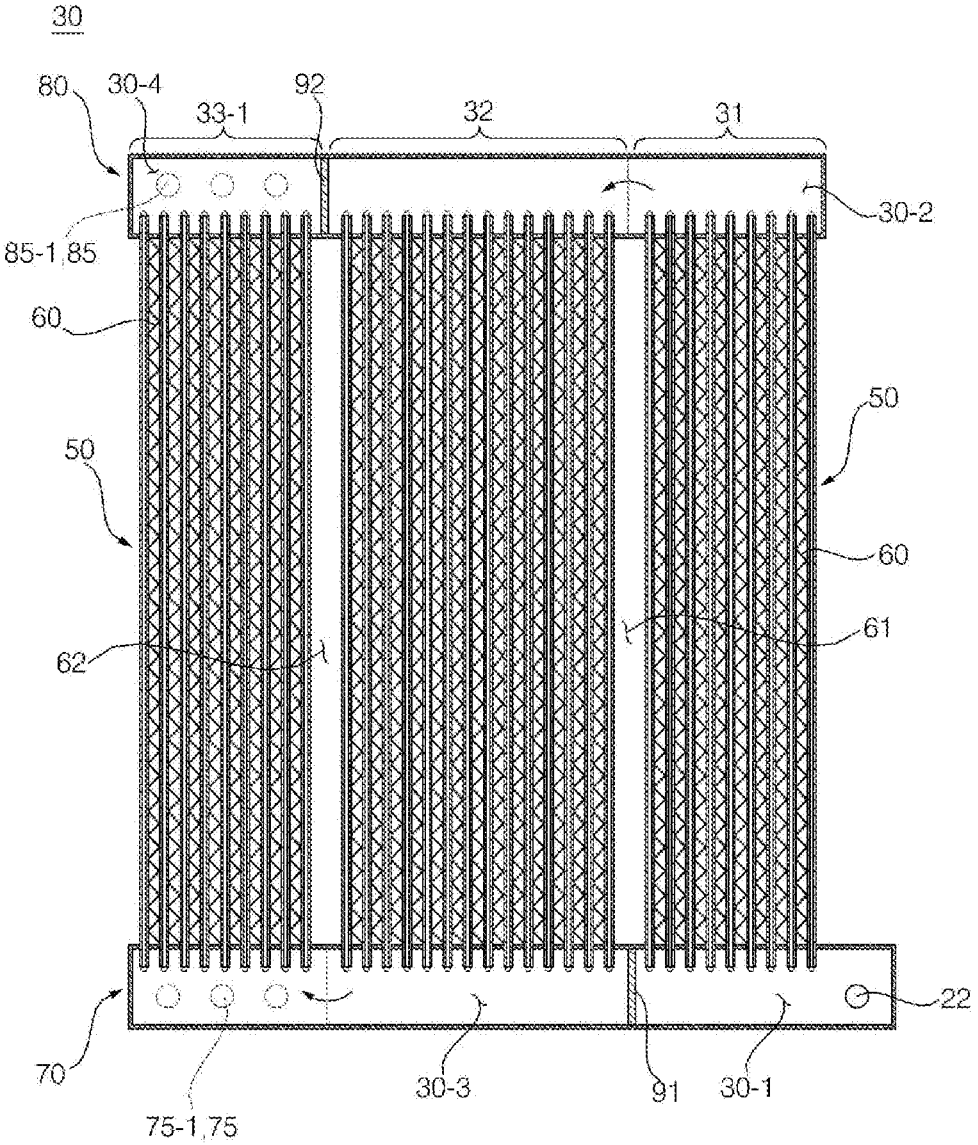
FIG. 5 is a cross-sectional view of a first heat exchange module of FIG. 3.

Hereinafter, embodiments of the present invention are described in detail with reference to the accompanying drawings. Advantages and features of the present invention and a method of achieving the same will be more clearly understood from embodiments described below with reference to the accompanying drawings. However, the invention is not limited to the following embodiments but may be implemented in various different forms. The embodiments are provided merely to complete disclosure of the present invention and to fully provide a person having ordinary skill in the art to which the invention pertains with the category of the invention. The invention is defined only by the category of the claims. Wherever possible, the same reference numbers will be used throughout the specification to refer to the same or like elements A micro channel type heat exchanger according a first embodiment is described with reference to FIGS. 2 through 7.

As illustrated, an air-conditioner may include a compressor 10 configured to compress a refrigerant, a condensation heat exchanger 26 configured to be supplied with the refrigerant from the compressor 10 and to condense the supplied refrigerant, an expansion unit 23 configured to expand the fluid refrigerant condensed by the condensation heat exchanger, and an evaporation heat exchanger 20 configured to evaporate the refrigerant expanded by the expansion unit 23.

It is understood that the expansion unit 23 may comprise, for example, an electronic expansion valve (eev) or a Bi-flow valve or a capillary tube.

The air-conditioner may further include a condensation ventilation fan 11 configured to flow air into the condensation heat exchanger 26 and an evaporation ventilation fan 12 configured to flow air into the evaporation heat exchanger 20.

An accumulator (not shown) may be disposed between the evaporation heat exchanger 20 and the compressor 10. The accumulator stores a fluid refrigerant and supplies a gaseous refrigerant to the compressor 10.

The evaporation heat exchanger 20 is a micro channel type heat exchanger. As shown, the evaporation heat exchanger 20 may be fabricated in two columns and has a stacked dual pass.

The evaporation heat exchanger 20 may be made of aluminum, but the material is not limited thereto.

The evaporation heat exchanger 20 may have a first heat exchange module 30 and a second heat exchange module 40 stacked on the first heat exchange module 30. The first heat exchange module 30 and the second heat exchange module 40 may be stacked vertically and are stacked front and back in the upright state. In the first heat exchange module 30 and the second heat exchange module 40, a refrigerant may flow from top to bottom or from bottom to top.

The refrigerant flows from the first heat exchange module 30 to the second heat exchange module 40.

Heat blocking members 100 and 105 for blocking or reducing the thermal conduction of the first heat exchange module 30 and the second heat exchange module 40 may be provided.

The heat blocking member may be made of a material having a relatively low heat conductivity. In the present embodiment, for example, the heat blocking member comprises a plate-like shape and is disposed between the first heat exchange module 30 and the second heat exchange module 40. However, it is understood that the heat blocking member may be fabricated in various shapes, such as, for example in a square, circle, or ellipse.

The heat blocking members 100 and 105 separate the first heat exchange module 30 and the second heat exchange module 40. The heat blocking members 100 and 105 thus prevent the first heat exchange module 30 and the second heat exchange module 40 from being in directly contact with each other.

The heat blocking members 100 and 105 may be disposed between the first heat exchange module 30 and the second heat exchange module 40, and connect the first heat exchange module 30 with the second heat exchange module 40.

The first heat exchange module 30 and the second heat exchange module 40 have a similar configuration; therefore, for convenience purposes, the configuration of the first heat exchange module 30 will generally be described.

The first heat exchange module 30 may include a plurality of flat tubes 50 configured to have a plurality of flow channels formed therein, a pin 60 configured to connect the flat tubes 50 and to conduct heat, a first lower header 70 connected to one side of the plurality of flat tubes 50 and configured to communicate with one side of the plurality of flat tubes 50 so that a refrigerant flows therein, a first upper header 80 connected to the other side of the plurality of flat tubes 50 and configured to communicate with the other side of the plurality of flat tubes 50 so that a refrigerant flows therein, and a baffle 90 formed in at least any one of the first lower header 70 and the first upper header 80 and configured to partition the inside of the first lower header 70 or the first upper header 80 to block a flow of a refrigerant.

The second heat exchange module 40 may include a plurality of flat tubes 50 configured to have a plurality of flow channels formed therein, a pin 60 configured to connect the flat tubes 50 and conduct heat, a second lower header 71 connected to one side of the plurality of flat tubes 50 and configured to communicate with one side of the plurality of flat tubes 50 so that a refrigerant flows therein, a second upper header 81 connected to the other side of the plurality of flat tubes 50 and configured to communicate with the other side of the plurality of flat tubes 50 so that a refrigerant flows therein, and a baffle 90 formed in at least ant one of the second lower header 71 and the second upper header 81 and configured to partition the inside of the second lower header 71 or the second upper header 81 to block a flow of a refrigerant.

The flat tubes 50 may be made of a metal material, but are not limited thereto. For example, in the present embodiment, for example, the flat tube 50 is made of aluminum. The first lower header 70 and the first upper header 80 may also be made of aluminum, but are not limited thereto. In some embodiments, for example, the elements of the first heat exchange module 30 may be made of another metal material, such as copper.

A plurality of the flow channels may be formed within the flat tube 50. The flow channel of the flat tube 50 may extend in a lengthwise direction of the flat tube 50. The flat tube 50 may be vertically disposed, and a refrigerant may flow in up and down directions.

Figure 6:
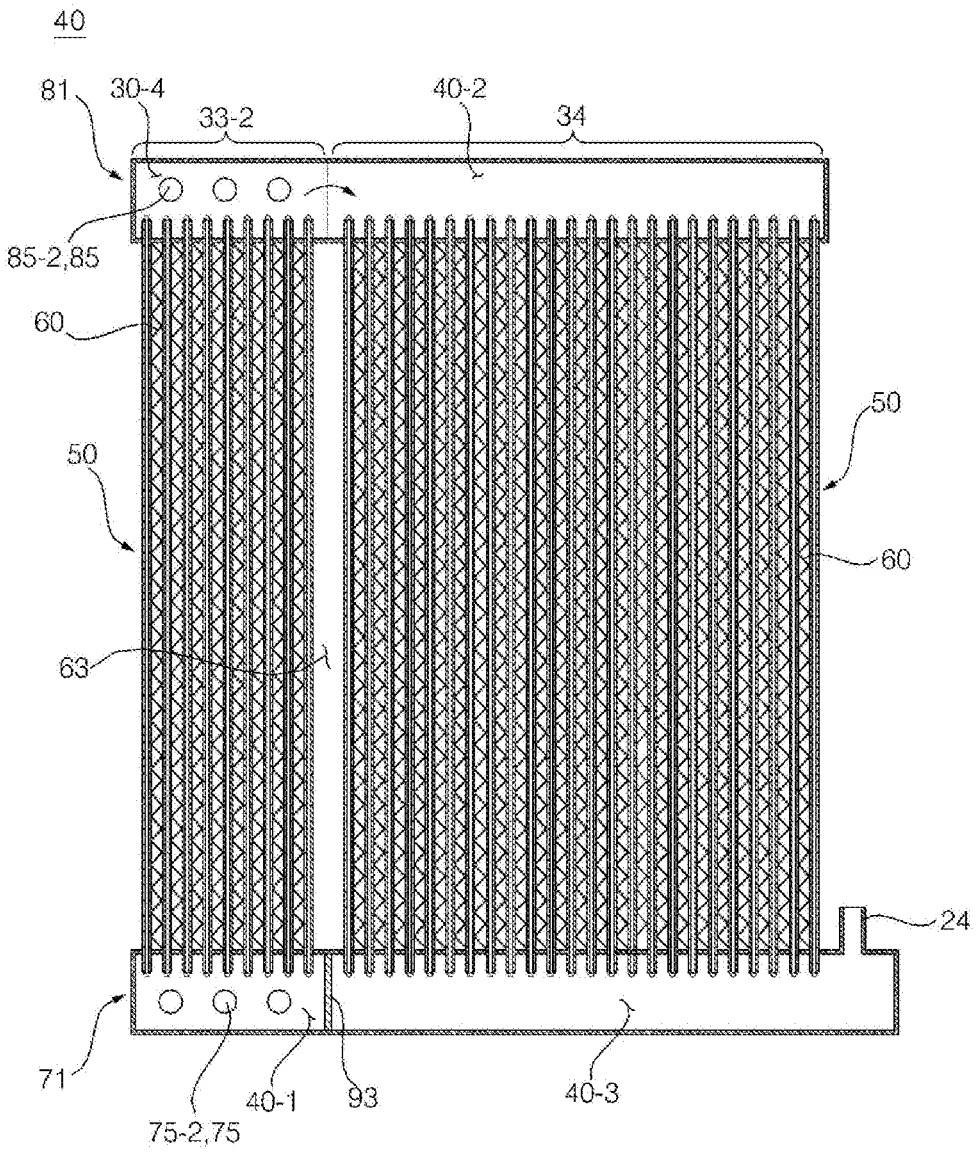
FIG. 6 is a cross-sectional view of a second heat exchange module of FIG. 3.
Figure 7:
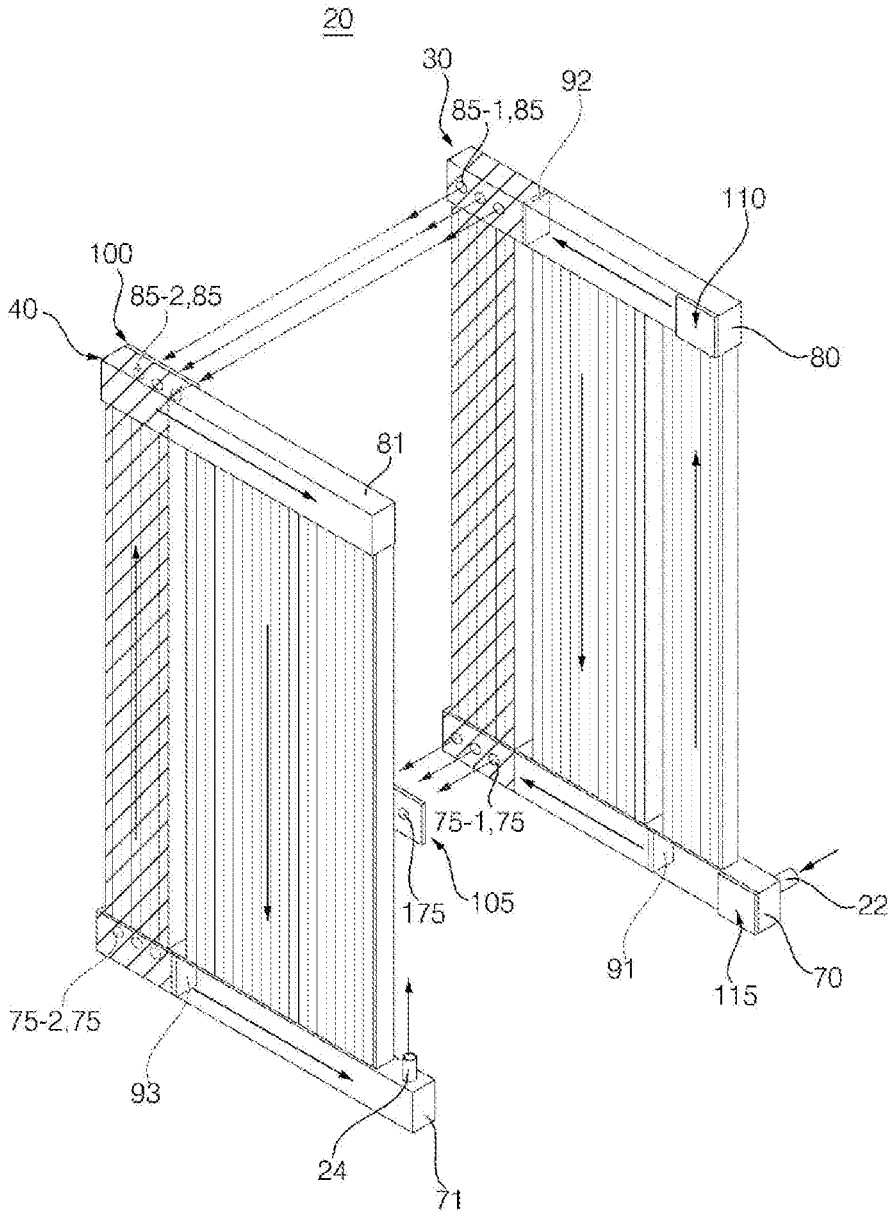
FIG. 7 is an exemplary diagram showing the third pass of the evaporation heat exchanger of FIG. 4.

As shown in FIG. 6, the plurality of flat tubes 50 may be stacked left and right. The upper side of the flat tube 50 may be inserted into the first upper header 80 and communicate with the inside of the first upper header 80. The lower side of the flat tube 50 may be inserted into the first lower header 70 and communicate with the inside of the first lower header 70.

The pin 60 may be made of a metal material and conduct heat. The pin 60 may be made of the same material as the flat tube 50. In the present embodiment, for example, the pin 60 is made of aluminum.

The pin 60 may be in contact with two flat tubes 50. As shown, the pin 60 is disposed between the two flat tubes 50. The pin 60 may have a curved shape. Thus, the pin 60 may connect the two flat tubes 50 that are stacked left and right and conduct heat.

The baffle 90 is configured to change the flow direction of a refrigerant. The direction of a refrigerant that flows at the left of the baffle 90 and the direction of a refrigerant that flows at the right of the baffle 90 may be opposite.

Four passes may be formed in the evaporation heat exchanger 20 due to the baffles 90 installed at the first heat exchange module 30 and the second heat exchange module 40.

For example, a first pass 31, a second pass 32, and part of a third pass 33 may be formed in the first heat exchange module 30. The remainder of the third pass 33 and a fourth pass 34 may be formed in the second heat exchange module 40.

In the present embodiment, for example, part of the third pass 33 formed in the first heat exchange module 30 is referred to herein as a "(3-1)-th pass 33-1," and the remainder of the third pass 33 formed in the second heat exchange module 40 is referred to herein as a "(3-2)-th pass 33-2."

The (3-1)-th pass 33-1 and the (3-2)-th pass 33-2 are physically separated and disposed in the first heat exchange module 30 and the second heat exchange module 40, but operate like a single pass.

Additionally, the (3-1)-th pass 33-1 and the (3-2)-th pass 33-2 may be distributed and disposed in the two heat exchange modules 30 and 40, and may be stacked and installed. Thus, a ratio of the third pass 33 to all the passes can be easily controlled because the (3-1)-th pass 33-1 and the (3-2)-th pass 33-2 can be distributed and installed on the two heat exchange modules 30 and 40.

Because the (3-1)-th pass 33-1 and the (3-2)-th pass 33-2 can be distributed and disposed, a ratio of the third pass 33 can be controlled in the state in which the number of flat tubes 50 of the first heat exchange module 30 and the number of flat tubes 50 of the second heat exchange module 40 are identically configured.

In the present embodiment, for example, the flat tubes 50 of the first pass 31 and the second pass 32 are physically separated. A space for physically separating the passes is referred to herein as a separation space.

In the present embodiment, for example, a separated space is formed between the first pass 31 and the second pass 32, which is referred to herein as a first separation space 61. Likewise, a separated space is also formed between the second pass 32 and the (3-1)-th pass 33-1, which is referred to herein as a second separation space 62. A separated space is also formed between the (3-2)-th pass 33-2 and the fourth pass 34, which is referred to herein as a third separation space 63.

The separation spaces 61, 62, and 63 block heat from being delivered to an adjacent pass. The separation spaces 61, 62 and 63 may also block heat from being delivered to an adjacent flat tube.

The separation spaces 61, 62 and 63 may be formed by not forming a pin 60 connecting the flat tubes 50.

The baffle 90 may be disposed at the upper or lower side of the separation spaces 61, 62, and 63.

The direction of a refrigerant in the passes may be changed in the upper header 80, 81 or the lower header 70, 71. The baffle 90 may be disposed in the upper header 80, 81 or the lower header 70, 71 in order to change the direction of a refrigerant.

In the present embodiment, for example, an inflow pipe 22 may be connected to the first pass 31, and a discharge pipe 24 may be connected to the fourth pass 34.

The baffle 90 may include a first baffle 91 configured to partition the first pass 31 and the second pass 32, a second baffle 92 configured to partition the second pass 32 and the (3-1)-th pass 33-1, and a third baffle 93 configured to partition the (3-2)-th pass 33-2 and the fourth pass 34.

In the present embodiment, for example, the first baffle 91 and the second baffle 92 may be disposed in the first heat exchange module 30, and the third baffle 93 may be disposed in the second heat exchange module 40. It is understood that the configuration is not limited thereto and the number and locations of the baffles may be different than disclosed in the exemplar embodiment.

Thus, while the (3-1)-th pass 33-1 and the (3-2)-th pass 33-2 may be disposed in different heat exchange modules, refrigerants in the (3-1)-th pass 33-1 and the (3-2)-th pass 33-2 flow in the same direction.

In the present embodiment, for example, the first baffle 91 may be disposed within the first lower header 70, the second baffle 92 may be disposed within the first upper header 80, and the third baffle 93 may be disposed within the second lower header 71.

The inflow pipe 22 may be disposed in the first lower header 70 of the first pass 31. The discharge pipe 24 may be disposed in the second lower header 71 of the fourth pass 34. It is understood that if the locations of the inflow pipe 22 and the discharge pipe 24 are changed, the location where the baffle 90 is disposed may be changed.

In an embodiment of the present invention, for example, the plurality of heat exchange modules (e.g., the first heat exchange module 30 and the second heat exchange module 40) may be distributed and the third pass 33 may be disposed in the plurality of heat exchange modules.

The inside of the first lower header 70 may be partitioned into a (1-1)-th space 30-1 and a (1-3)-th space 30-3 by the first baffle 91. The inside of the first upper header 80 may be partitioned into a (1-2)-th space 30-2 and a (1-4)-th space 30-4 by the second baffle 92. The inside of the second lower header 71 may be partitioned into a (2-1)-th space 40-1 and a (2-3)-th space 40-3 by the third baffle 93.

In such configuration, a baffle is not disposed within the second upper header 81. The inside of the second upper header 81 is referred to herein as a "(2-2)-th space 40-2."

The inflow pipe 22 may be connected to the (1-1)-th space 30-1. The discharge pipe 24 may be connected to the (2-3)-th space 40-3.

The (3-1)-th pass 33-1 and the (3-2)-th pass 33-2 may be connected through the first lower header 70 and the second lower header 71 and connected through the first upper header 80 and the second upper header 81.

In the present embodiment, for example, a lower hole 75 may be formed so that a refrigerant may flow to another heat exchange module. Thus, the lower hole 75 may connect the first lower header 70 and the second lower header 71 and provide a refrigerant flow path. A refrigerant may flow in another heat exchange module through the lower hole 75. It is understood that a pipe may be installed in the lower hole 75, and the pipe may connect the lower holes 75.

In the present embodiment, for example, the lower hole 75 may directly connect the (1-3)-th space 30-3 and the (2-1)-th space 40-1. The lower hole 75 formed in the first heat exchange module 30 is referred to herein as a "first lower hole 75-1," and the lower hole 75 formed in the second heat exchange module 40 is referred to herein as a "second lower hole 75-2."

The first and the second lower holes 75-1 and 75-2 may connect the second pass 32 with the (3-2)-th pass 33-2. When the first heat exchange module 30 and the second heat exchange module 40 are provided in a furnace, the first and the second lower holes 75-1 and 75-2 are connected. Accordingly, a separate welding procedure for connecting the first and the second lower holes 75-1 and 75-2 is not performed. Accordingly, manufacturing cost and time can be reduced because the first and the second lower holes 75-1 and 75-2 are directly bonded without using a pipe.

A plurality of the first lower holes 75-1 and the second lower holes 75-2 may be formed so that a flow from the first heat exchange module 30 to the second heat exchange module 40 is smooth.

Furthermore, an upper hole 85 that connects the first upper header 80 and the second upper header 81 may be formed. The upper hole 85 formed in the first heat exchange module 30 is referred to herein as a "first upper hole 85-1," and the upper hole 85 formed in the second heat exchange module 40 is referred to herein as a "second upper hole 85-2."

In the present embodiment, for example, the first upper hole 85-1 may be formed in the (1-3)-th space 30-4, and the second upper hole 85-2 may be formed in the (2-2)-th space 40-2. It is understood that the upper holes may also be connected through a separate pipe.

The pipe may be disposed between the upper holes or between the lower holes or on the outside. For example, a pipe (not shown) that connects the first lower header 70 and the second lower header 71 may be installed on the outside instead of the lower hole 75. Furthermore, a pipe (not shown) that connects the first upper header 80 and the second upper header 81 may be installed on the outside instead of the upper hole 85.

In the present embodiment, at least two heat blocking members may be installed. For example, the first heat blocking member 100 may be disposed between the first and the second upper holes 85-1 and 85-2. A first plate hole 185 configured to communicate with the first upper hole 85-1 and the second upper hole 85-2 may be formed in the first heat blocking member 100. The number of first plate holes 185 corresponds to the number of upper holes. In the present embodiment, a plurality of the upper holes are formed, and a plurality of the first plate holes 185 are also formed in correspondence with the plurality of upper holes.

For example, the second heat blocking member 105 may be disposed between the first and the second lower holes 75-1 and 75-2. A second plate hole 175 configured to communicate with the first lower hole 75-1 and the second lower hole 75-2 may be formed in the second heat blocking member 105. The number of second plate holes 175 corresponds to the number of lower holes. In the present embodiment, a plurality of the lower holes are formed, and a plurality of the second plate holes 175 are also formed in correspondence with the plurality of lower holes.

The first heat blocking member 100 may be disposed between the first upper header 80 and the second upper header 81 and fixed thereto. The first heat blocking member 100 may separate the first upper header 80 and the second upper header 81 at an interval of the thickness thereof.

The second heat blocking member 105 may be inserted between the first lower header 70 and the second lower header 71 and fixed thereto. The second heat blocking member 105 may separate the first lower header 70 and the second lower header 82 at an interval of the thickness thereof.

The first and the second heat exchange modules 30 and 40 may be spaced apart from each other at a specific interval by the first and the second heat blocking members 100 and 105. The heat blocking members can block or minimize heat conductivity between the first and the second heat exchange modules 30 and 40.

A third heat blocking member 110 and a fourth heat blocking member 115 may be disposed in order to more stably support the first and the second heat exchange modules 30 and 40. For example, the third heat blocking member 110 may disposed between the upper headers 80 and 81, and the fourth heat blocking member 115 may be disposed between the lower headers 70 and 71.

If the first heat blocking member 100 is located on one side of the upper headers 80 and 81, the third heat blocking member 110 is located on the other side of the upper headers 80 and 81. If the second heat blocking member 105 is located on one side of the lower headers 70 and 71, the fourth heat blocking member 115 is located on the other side of the lower headers 70 and 71. The third and the fourth heat blocking members 110 and 115 may be installed at opposite sides of the first and the second heat blocking members 100 and 105. A plate hole is not formed in the third heat blocking member 110 and the fourth heat blocking member 115.

It is understood that at least one of the third heat blocking member 110 and the fourth heat blocking member 115 may be the same as the first heat blocking member 100.

The third heat blocking member 110 and the fourth heat blocking member 115 may support the first heat exchange module 30 and the second heat exchange module 40.

In the present embodiment, for example, the first and the second heat blocking members 100 and 105 are installed at the left side, and the third and the fourth heat blocking members 110 and 115 are installed at the right side.

A heat blocking space 101 may be formed in the first and the second heat exchange modules 30 and 40 by the first, the second, the third, and the fourth heat blocking members 100, 105, 110, and 115.

The first heat blocking member 100 and the second heat blocking member 105 can function to suppress the leakage of a refrigerant. For example, when a refrigerant flows through the lower hole 75, the second heat blocking member 105 can suppress the leakage of the refrigerant passing through the lower hole. When a refrigerant flows through the upper hole 85, the first heat blocking member 100 can suppress the leakage of the refrigerant passing through the upper hole 85.

When the first heat exchange module 30 and the second heat exchange module 40 are shaped through a brazing process, the heat blocking members 100, 105, 110, and 115 may also be shaped. Accordingly, a separate process for assembling the heat blocking members 100, 105, 110, and 115 is not required.

In the present embodiment, for example, flat tubes 50, that is, 15% of all of the flat tubes of the first heat exchange module 30 and the second heat exchange module 40 may be disposed in the first pass 31. 20% of all of the flat tubes of the first heat exchange module 30 and the second heat exchange module 40 may be disposed in the second pass 32. 30% of all of the flat tubes of the first heat exchange module 30 and the second heat exchange module 40 may be disposed in the third pass.

In the present embodiment, for example, the number of flat tubes of the (3-1)-th pass 33-1 may be the same as that of the (3-2)-th pass 33-2. It is understood that there may be more flat tubes of one of the (3-1)-th pass 33-1 and the (3-2)-th pass 33-2 than flat tubes of the other of the (3-1)-th pass 33-1 and the (3-2)-th pass 33-2. For example, there may be more flat tubes of the (3-2)-th pass 33-2 than of the (3-1)-th pass 33-1.

The (3-1)-th pass 33-1 and the (3-2)-th pass 33-2 may be distributed and disposed in the two heat exchange modules 30 and 40.

The (3-1)-th pass 33-1 and the (3-2)-th pass 33-2 may be distributed and disposed in different heat exchange modules 30 and 40, but operate like a single pass. In other words, the flow directions of refrigerants in the (3-1)-th pass 33-1 and the (3-2)-th pass 33-2 may be the same.

35% of all of the flat tubes of the first heat exchange module 30 and the second heat exchange module 40 may be disposed in the fourth pass 34.

In the present embodiment, for example, a pressure loss of a refrigerant can be reduced by gradually increasing the number of flat tubes 50 in the passes 31, 32, 33, and 34. The number of passes 31, 32, 33, and 34 can be gradually increased due to the third pass 33 distributed to the two heat exchange modules.

A refrigerant is evaporated within the flat tube 50 because the first heat exchange module 30 and the second heat exchange module 40 operate as the evaporation heat exchanger 20. When a liquefied refrigerant is evaporated as a gaseous refrigerant, specific volume of the refrigerant is increased.

In the present embodiment, for example, the amount of a refrigerant evaporated increases as it flows toward the first pass 31, the second pass 32, and the third pass 33. Accordingly, it is advantageous to gradually increase the volume of each of the passes 31, 32, 33, and 34 in order to reduce pressure loss.

If the number of flat tubes of each pass is identically configured as in a conventional technology, the dryness of a refrigerant is high in the discharge-side pass. That is, there are problems in that a pressure drop of a refrigerant in a gaseous area increases to deteriorate suction pressure and the circulation flow of the refrigerant is reduced because the volumes of passes are the same compared to a case where the dryness of the refrigerant is great.

In the present embodiment, for example, a pressure loss of a refrigerant can be reduced by gradually increasing the number of flat tubes of each pass. The dryness of a refrigerant can be regularly maintained in each pass by gradually increasing the number of flat tubes of each pass.

Accordingly, the first pass 31 and the second pass 32 may be fabricated less than 50% of the evaporation heat exchanger 20. The third pass 33 may be fabricated 30% to 50% of the evaporation heat exchanger 20. The third pass 33 may be distributed and disposed in the first heat exchange module 30 and the second heat exchange module 40.

A refrigerant flow of the evaporation heat exchanger 20 is described below.

A refrigerant supplied to the inflow pipe 22 may flow along the first pass 31. Accordingly, the refrigerant supplied to the inflow pipe 22 may flow from the (1-1)-th space 30-1 to the (1-2)-th space 30-2, and the refrigerant that flows to the (1-2)-th space 30-2 may flow to the (1-3)-th space 30-3 along the second pass 32. The refrigerant that flows to the (1-3)-th space 30-3 may flow along the third pass 33.

The refrigerant of the (1-3)-th space 30-2 may be divided and flow to the (3-1)-th pass 33-1 or the (3-2)-th pass 33-2 because the third pass 33 includes the (3-1)-th pass 33-1 and the (3-2)-th pass 33-2.

Some of the refrigerant of the (1-3)-th space 30-3 may flow in the (1-4)-th space 30-4 along the (3-1)-th pass 33-1. The refrigerant of the (1-4)-th space 30-4 may flow in the (2-2)-th space 40-2 (i.e., the upper side of the (3-2)-th pass) through the upper hole 85. The refrigerant introduced into the (2-2)-th space 40-2 (i.e., the upper side of the (3-2)-th pass) through the upper hole 85 may flow horizontally along the (2-2)-th space 40-2 and may flow toward the upper side of the fourth pass 34.

The remainder of the refrigerant of the (1-3)-th space 30-3 may flow in the second heat exchange module 40 through the lower hole 75. The remaining refrigerant may flow in the (2-1)-th space 40-1 through the lower hole 75. Furthermore, the refrigerant of the (2-1)-th space 40-1 may flow in the (2-2)-th space 40-2 along the (3-2)-th pass 33-2. That is, the refrigerant of the second pass 32 may flow in the (2-2)-th space 40-2 via any one of the two separated (3-1)-th pass 33-1 and (3-2)-th pass 33-2.

The refrigerants collected in the (2-2)-th space 40-2 may flow along the (2-2)-th space 40-2 and then flow toward the fourth pass 34. The refrigerant passing through the fourth pass 34 may be discharged from the evaporation heat exchanger 20 through the discharge pipe 24.

In the present embodiment, for example, refrigerants passing through the second pass 32 may flow along the (3-1)-th pass 33-1 disposed in the first heat exchange module 30 and the (3-2)-th pass 33-2 disposed in the second heat exchange module 40 and be combined in the (2-2)-th space 40-2.

The third passes 33 may be disposed in the different heat exchange modules 30 and 40, but form the same flow direction. The upper hole 85 and the lower hole 75 may be formed so that the separated (3-1)-th pass 33-1 and (3-2)-th pass 33-2 travel in the same direction and are then joined.

Figure 8:
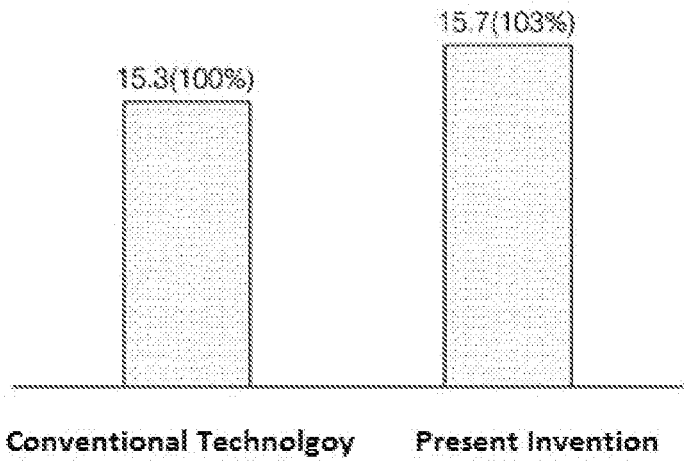
FIG. 8 is a performance graph according to an embodiment of the invention.

FIG. 8 is a performance graph according to an embodiment of the present invention. As shown, the micro channel type heat exchanger according to the present embodiment has an improved thermal exchange performance of about 3% compared to a conventional technology.

Figure 9:
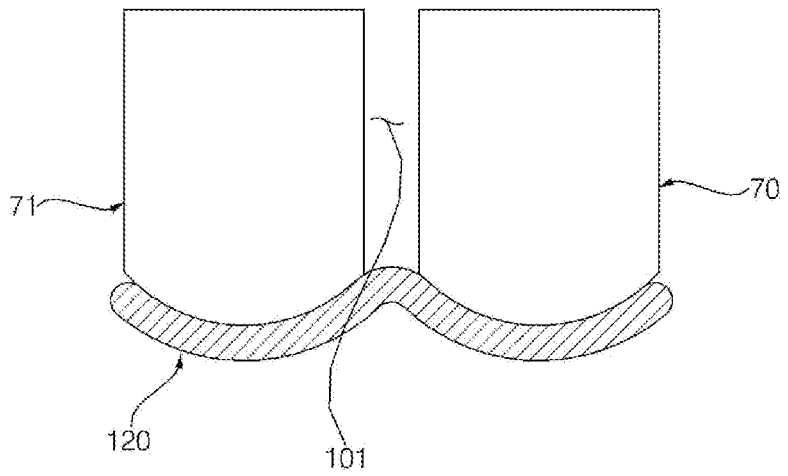
FIG. 9 is an exemplary diagram showing the installation of a heat blocking member according a second embodiment of the invention.

A second embodiment of the present invention is described below with reference to the embodiment illustrated in FIG. 9.

Unlike in the first embodiment, a heat blocking member 120 according to the second embodiment is not located between headers, but connects the headers. As described above, the heat blocking members according to the first embodiment are inserted between the headers and fixed thereto. In contrast, the heat blocking member 120 according to the second embodiment connects the outsides of the headers.

More particularly, for example, the heat blocking member 120 connects the first and the second lower headers 70 and 71 or connects the first and the second upper headers 80 and 81. The heat blocking member 120 may be curved along the outside surfaces of the first and the second lower headers 70 and 71. It is understood, however, that the heat blocking member 120 may be formed in a plate-like shape. The heat blocking member 120 can be fixed to the first and the second lower headers 70 and 71.

Similar to the first embodiment, a heat blocking space 101 may be formed between the first and the second lower headers 70 and 71. A heat blocking space 101 may also be formed between the first and the second upper headers 80 and 81 (not shown).

The remaining elements of the second embodiment are the same as those of the first embodiment, and thus for convenience purposes a detailed description thereof is omitted.

Figure 10:
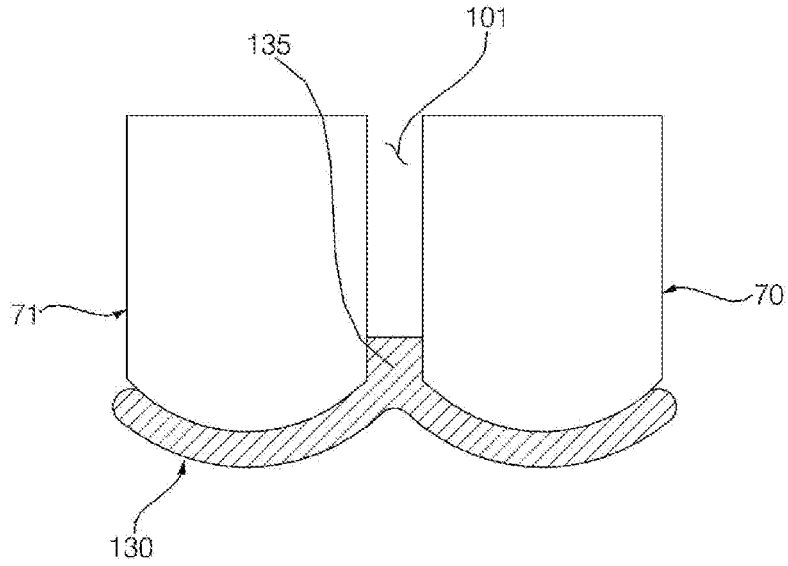
FIG. 10 is an exemplary diagram showing the installation of a heat blocking member according to a third embodiment of the invention.

A third embodiment of the present invention is described below with reference to the embodiment illustrated in FIG. 10.

In the third embodiment, a heat blocking member 130 is similar to that of the second embodiment, but further includes an insertion part 135 inserted between headers. As shown, the insertion part 135 may be inserted between the first and the second lower headers 70 and 71 and fixed thereto.

A heat blocking space 101 may be secured by the insertion part 135. The insertion part 135 may support the first heat exchange module 30 and the second heat exchange module 40. Although an external impact is applied, the heat blocking space 101 is maintained by the insertion part 135.

The heat blocking member 130 may be disposed at the first and the second upper headers 80 and 81. The heat blocking member 130 may be disposed at the first and the second lower headers 70 and 71.

The remaining elements of the third embodiment are the same as those of the second embodiment, and thus for convenience purposes a detailed description thereof is omitted.

The heat exchanger of the present invention has at least one or more of the following effects.

First, as disclosed, embodiments of the present invention are configured to improve thermal exchange performance relative to that of conventional heat exchangers because the heat blocking member forming the heat blocking space is disposed between the first heat exchange module and the second heat exchange module and heat conductivity is minimized through the heat blocking member.

Second, as disclosed, embodiments of the present invention are configured such that thermal exchange performance is improved because the (3-1)-th pass disposed in the first heat exchange module and the (3-2)-th pass disposed in the second heat exchange module operate as a single pass.

Third, as disclosed, embodiments of the present invention are configured such that a ratio of flat tubes of the third pass to the number of all of flat tubes can be controlled because the third pass is distributed and disposed in the two heat exchange modules.

Fourth, as disclosed, embodiments of the present invention are configured such that there can be a reduction in pressure loss of a refrigerant when the heat exchanger is used as an evaporator because the number of flat tubes of each of the first pass, the second pass, and the third pass is gradually increased.

Fifth, as disclosed, embodiments of the present invention are configured such that there can be a reduction in pressure loss generated when a refrigerant is evaporated because the third pass of the four passes is distributed and disposed in different heat exchange modules, but the distributed passes operate as a single pass.

Although the embodiments of the present invention have been described with reference to the accompanying drawings, the present invention is not limited to the embodiments, but may be manufactured in various other forms. Those skilled in the art to which the present invention pertains will appreciate that the present invention may be implemented in other detailed forms without departing from the technical spirit or essential characteristics of the present invention. Accordingly, the aforementioned embodiments should be construed as being only illustrative from all aspects not as being restrictive.

What is claimed is:

1. A micro channel type heat exchanger comprising:

a first heat exchange module and a second heat exchange module that are stacked together;

a heat blocking member that separates the first heat exchange module and the second heat exchange module and forms a heat blocking space, wherein:

the first heat exchange module comprises:

a first lower header, a first upper header disposed upper side of the first lower header, and a plurality of flat tubes being in communication the first lower header and first upper header, an upper side of the plurality of flat tubes coupled to the first upper header and a lower side of the plurality of flat tubes coupled to the first lower header for flows refrigerant, and wherein:

the second heat exchange module comprises:

a second lower header disposed opposite the first lower header, a second upper header disposed opposite the first upper header, and a plurality of flat tubes being in communication the second lower header and second upper header, an upper side of the plurality of flat tubes coupled to the second upper header and a lower side of the plurality of flat tubes coupled to the second lower header for flows refrigerant, wherein the heat blocking member comprises:

a first heat blocking member formed in a planar shape having a thickness that is less than a width and a length thereof respectively, the first heat blocking member disposed on the left side between the first upper header and the second upper header to couple the first upper header and the second upper header without other coupling structures, a second heat blocking member formed in a planar shape having a thickness that is less than a width and a length thereof respectively, the second heat blocking member disposed on the left side between the first lower header and the second lower header to couple the first lower header and the second lower header without other coupling structures, a third heat blocking member formed in a planar shape having a thickness that is less than a width and a length thereof respectively, the third heat blocking member disposed on the right side between the first upper header and the second upper header without other coupling structures, and a fourth heat blocking member formed in a planar shape having a thickness that is less than a width and a length thereof respectively, the fourth heat blocking member disposed on the right side between the first lower header and the second lower header without other coupling structures, wherein the first heat blocking member and the third heat blocking member are disposed between the two upper headers facing each other and are not exposed to the outside, the second heat blocking member and the fourth heat blocking member are disposed between the two lower headers facing each other and are not exposed to the outside, wherein for each of the heat blocking members, one surface is in direct contact with any one header of the first heat exchange module, and another surface is in direct contact with any one header of the second heat exchange module wherein the first and the second lower headers have a longer length than the first and the second upper headers, wherein the first and second heat blocking members are disposed on a vertical line to each other, and wherein the third and fourth heat blocking members are not disposed on a vertical line by disposing the fourth heat blocking member at a position corresponding to the length difference between the first and second upper headers and the first and second lower headers.

2. The micro channel type heat exchanger of claim 1, wherein:

the heat blocking space is formed between the first heat exchange module and the second heat exchange module wherein the first heat exchange module further comprises:

a first baffle disposed within the first lower header, the first baffle forming a first pass and a second pass by partitioning an inside of the first lower header, and a second baffle disposed within the first upper header, the second baffle forming the second pass and a (3-1)-th pass of a third pass by partitioning an inside of the second upper header, and wherein:

the second heat exchange module further comprises:

a third baffle disposed within the second lower header, the third baffle forming a (3-2)-th pass of the third pass and a fourth pass by partitioning the second lower header, wherein:

the first pass is disposed in some of the plurality of flat tubes that are disposed in the first heat exchange module and along which the refrigerant flows in one direction;

the second pass is disposed in some of the remaining tubes of the plurality of flat tubes that are disposed in the first heat exchange module and along which the refrigerant supplied from the first pass flows in an opposite direction to the direction of the first pass;

the third pass is distributed and disposed in a remainder of the plurality of flat tubes that are disposed in the first heat exchange module other than the first pass and the second pass and in some of a plurality of flat tubes that are disposed in the second heat exchange module; and the fourth pass is disposed in a remainder of the plurality of flat tubes that are disposed in the second heat exchange module and along which the refrigerant supplied from the third pass flows in an opposite direction to the direction of the third pass, wherein the third pass comprises the (3-1)-th pass disposed in the remainder of the plurality of flat tubes that are disposed in the first heat exchange module other than the first pass and the second pass and along which the refrigerant supplied from the second pass flows in an opposite direction to the direction of the second pass and the (3-2)-th pass disposed in some of the plurality of flat tubes that are disposed in the second heat exchange module and along which the refrigerant supplied from the second pass flows in the opposite direction to the direction of the second pass and flows in the same direction as the direction of the (3-1)-th pass.

3. The micro channel type heat exchanger of claim 2, wherein the number of flat tubes that form the (3-1)-th pass is the same as the number of flat tubes that form the (3-2)-th pass.

4. The micro channel type heat exchanger of claim 2, wherein a number of flat tubes disposed in each of the first pass, the second pass, the third pass, and the fourth pass is gradually increased from the first pass to the fourth pass.

5. The micro channel type heat exchanger of claim 2, wherein:

15% of all of the flat tubes of the first heat exchange module and the second heat exchange module are disposed in the first pass, 20% of all of the flat tubes of the first heat exchange module and the second heat exchange module are disposed in the second pass, 30% of all of the flat tubes of the first heat exchange module and the second heat exchange module are disposed in the third pass, and 35% of all of the flat tubes of the first heat exchange module and the second heat exchange module are disposed in the fourth pass.

* * * * *